US011971031B2

(12) United States Patent
Dong et al.

(10) Patent No.: US 11,971,031 B2
(45) Date of Patent: Apr. 30, 2024

(54) PUMP BODY ASSEMBLY, HEAT EXCHANGE APPARATUS, FLUID MACHINE AND OPERATING METHOD THEREOF

(71) Applicant: GREE ELECTRIC APPLIANCES, INC. OF ZHUHAI, Qianshan Zhuhai (CN)

(72) Inventors: Mingzhu Dong, Zhuhai (CN); Yusheng Hu, Zhuhai (CN); Huijun Wei, Zhuhai (CN); Jia Xu, Zhuhai (CN); Zhongcheng Du, Zhuhai (CN); Liping Ren, Zhuhai (CN); Sen Yang, Zhuhai (CN); Zhi Li, Zhuhai (CN); Peilin Zhang, Zhuhai (CN); Shebing Liang, Zhuhai (CN); Zhengliang Shi, Zhuhai (CN); Rongting Zhang, Zhuhai (CN); Ning Ding, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 66 days.

(21) Appl. No.: 17/639,888

(22) PCT Filed: Aug. 24, 2020

(86) PCT No.: PCT/CN2020/110701
§ 371 (c)(1),
(2) Date: Mar. 2, 2022

(87) PCT Pub. No.: WO2021/098314
PCT Pub. Date: May 27, 2021

(65) Prior Publication Data

US 2022/0290669 A1 Sep. 15, 2022

(30) Foreign Application Priority Data

Nov. 22, 2019 (CN) ..... 201911158497.9

(51) Int. Cl.
*F04C 18/22* (2006.01)
*F04C 29/00* (2006.01)

(52) U.S. Cl.
CPC ..... *F04C 18/22* (2013.01); *F04C 29/00* (2013.01); *F04C 29/0021* (2013.01); *F04C 2240/20* (2013.01); *F04C 2240/30* (2013.01)

(58) Field of Classification Search
CPC ..... F04C 18/22; F04C 29/00; F04C 29/0021; F04C 2240/20; F04C 2240/30
See application file for complete search history.

(56) References Cited

U.S. PATENT DOCUMENTS 1,393,802 A 10/1921 Lupton, Jr.
3,810,721 A * 5/1974 Eyer ..... F01C 1/102 91/197
2017/0204857 A1 7/2017 Garside

FOREIGN PATENT DOCUMENTS

CN 103511259 A 1/2014
CN 204877939 U 12/2015
(Continued)

OTHER PUBLICATIONS

Machine Translation and Foreign Patent Publication for Chinese Patent Publication CN 106065860 A, Inventor: Kong et al; Title: A Pump Body of Compressor and Compressor, Published on Nov. 2, 2016. (Year: 2013).*
(Continued)

*Primary Examiner* — Mary Davis
(74) *Attorney, Agent, or Firm* — Christensen O'Connor Johnson Kindness PLLC

(57) ABSTRACT

The present disclosure provides a pump body assembly, a heat exchange apparatus, a fluid machine and an operating method thereof. The pump body assembly includes a piston, a shaft, a piston sheath, and a cylinder. The shaft drives the piston to rotate and reciprocate within the piston sheath
(Continued)

while rotating. The piston sheath is located in the cylinder, and a compression chamber is defined between an outer circumferential wall of the piston and an inner wall of the cylinder. A pressure relief recess is defined in the outer circumferential wall of the piston or the inner wall of the cylinder at a position corresponding to the compression chamber.

18 Claims, 10 Drawing Sheets

(56) References Cited

FOREIGN PATENT DOCUMENTS

| | | | |
|---|---|---|---|
| CN | 107387410 | A | 11/2017 |
| CN | 110905809 | A | 3/2020 |
| DE | 3725806 | A1 | 2/1989 |
| JP | 2019135377 | A | 8/2019 |

OTHER PUBLICATIONS

International Search Report dated Oct. 13, 2020, issued in corresponding International Application No. PCT/CN2020/110701, filed Aug. 24, 2020, 2 pages.
Extended European Search Report dated Aug. 5, 2022, issued in corresponding Chinese Application No. 20890323.7, 7 pages.
Office Action dated May 9, 2023, issued in corresponding Japanese Application No. 2022-511003, 4 pages.

* cited by examiner

PUMP BODY ASSEMBLY, HEAT EXCHANGE APPARATUS, FLUID MACHINE AND OPERATING METHOD THEREOF

CROSS-REFERENCE TO RELATED APPLICATION

This application is a National Stage of International Application No. PCT/CN2020/110701, filed Aug. 24, 2020, which claims priority of China Patent Application No. 201911158497.9, filed on Nov. 22, 2019, the contents of which is—are hereby incorporated by reference in itstheir entirety.

TECHNICAL FIELD

The present disclosure relates to the field of heat exchange system, and in particular, to a pump body assembly, a heat exchange apparatus, a fluid machine and an operating method thereof.

BACKGROUND

In a pump body structure of a rotary compressor and the rotary compressor known to the inventors, the shaft drives the piston to rotate, and the piston drives the piston sheath to rotate in the cylinder. The piston respectively reciprocates with respect to both the shaft and the piston sheath, and the two reciprocating motions are perpendicular to each other. In this process, suction, compression and exhaust are realized.

In the processes of suction, compression, and exhaust, the radial distance between the piston and the inner wall of the cylinder changes periodically. In the process of suction, the radial distance between the piston and the inner wall of the cylinder keeps increasing; in the processes of compression and exhaust, the radial distance keeps decreasing until it reaches the order of $10^{-2}$ mm.

SUMMARY

According to an aspect of the present disclosure, a pump body assembly is provided, including: a piston, a shaft, a piston sheath, and a cylinder. The shaft drives the piston to rotate and reciprocate within the piston sheath while rotating. The piston sheath is located in the cylinder, and a compression chamber is defined between an outer circumferential wall of the piston and an inner wall of the cylinder, and a pressure relief recess is defined in the outer circumferential wall of the piston or the inner wall of the cylinder at a position corresponding to the compression chamber.

In some embodiments, other portions of the outer circumferential wall of the piston, except the position where the pressure relief recess is located, is capable of mating with the inner wall of the cylinder during movement.

In some embodiments, the pressure relief recess extends along a circumferential direction of the piston.

In some embodiments, a sum of arc lengths respectively between two ends of the pressure relief recess along a rotation direction of the piston and corresponding two ends of the compression chamber is greater than or equal to 2 mm.

In some embodiments, the cylinder further includes an exhaust channel, and in two ends of the pressure relief recess along a rotation direction of the piston, an arc length between an end adjacent to the exhaust channel and the exhaust channel is greater than or equal to 1 mm.

In some embodiments, in an axial direction of the shaft, a distance between the pressure relief recess and an edge of the piston is greater than or equal to 1 mm; or in an axial direction of the shaft, a distance between the pressure relief recess and an edge of the cylinder is greater than or equal to 1 mm.

In some embodiments, the pressure relief recess includes at least one pressure relief groove; on a condition that the pressure relief grooves are multiple, the multiple pressure relief grooves are communicated with or separated from each other.

In some embodiments, a groove width of each pressure relief groove is greater than or equal to 0.5 mm.

In some embodiments, a groove depth of each pressure relief groove is greater than or equal to 0.1 mm.

In some embodiments, a cross-sectional area of all pressure relief grooves is greater than or equal to 0.025 square millimeters.

In some embodiments, a ratio of a sum of a cross-sectional area of all pressure relief grooves to a cross-sectional area of the piston along a direction perpendicular to an axis of the cylinder is greater than or equal to 0.001 and smaller than or equal to 0.5.

In some embodiments, the cross-section of each pressure relief groove is rectangular or fan-shaped.

In some embodiments, the number of the pressure relief groove is one, and the pressure relief groove extends along a circumferential direction of the piston or a circumferential direction of the cylinder; or the number of the pressure relief grooves is two, and the two pressure relief grooves are crossed; or the number of the pressure relief grooves is three, and the three pressure relief grooves are in a shape of H; or the number of the pressure relief grooves is three, and the three pressure relief grooves are in a shape of I; or the number of the pressure relief grooves is plural, and the pressure relief grooves are in a shape of a fishbone; or the number of the pressure relief grooves is two, wherein a first pressure relief groove extends along a circumferential direction of the piston or a circumferential direction of the cylinder, and a second pressure relief groove has a ring shape and is crossed with the first pressure relief groove.

In some embodiments, a ratio of a volume of the pressure relief recess to a cylinder displacement of the pump body assembly is greater than or equal to 0.001 and smaller than or equal to 0.02.

According to another aspect of the present disclosure, a fluid machine is provided, including the above-described pump body assembly.

In some embodiments, the fluid machine is a compressor.

According to another aspect of the present disclosure, a heat exchange apparatus is provided, including the above-described fluid machine.

According to another aspect of the present disclosure, an operating method of the fluid machine is provided, wherein the cylinder of the fluid machine defines a suction channel, a pressure relief channel, and an exhaust channel spaced from each other; the pressure relief channel is communicated with the chamber of the cylinder through a pressure relief port, and the exhaust channel is communicated with the chamber of the cylinder through an exhaust port. The operating method includes: at the end of exhaust of the fluid machine, the pressure relief recess of the pump body assembly of the fluid machine is directly or indirectly communicated with the pressure relief port while isolated from the exhaust port.

BRIEF DESCRIPTION OF THE DRAWINGS

The accompanying drawings of the specification constituting a part of the present disclosure are used to provide a further understanding of the present disclosure, and the exemplary embodiments and descriptions of the present disclosure are used to explain the present disclosure, and do not constitute an improper limitation of the present disclosure. In the drawings.

Figure 1:
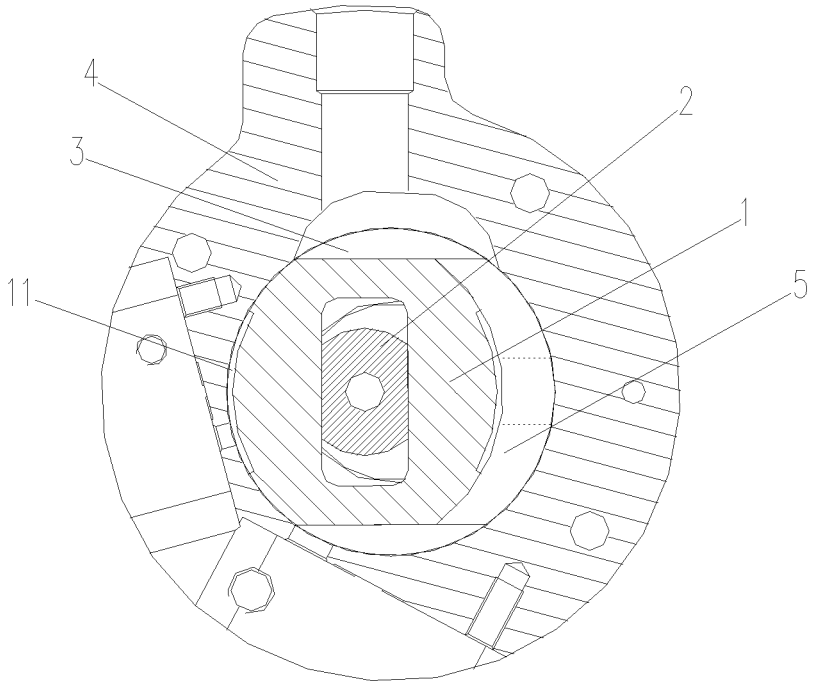
FIG. 1 is a schematic view of an internal structure of a pump body assembly in a first embodiment of the pump body assembly of the present disclosure.
Figure 2:
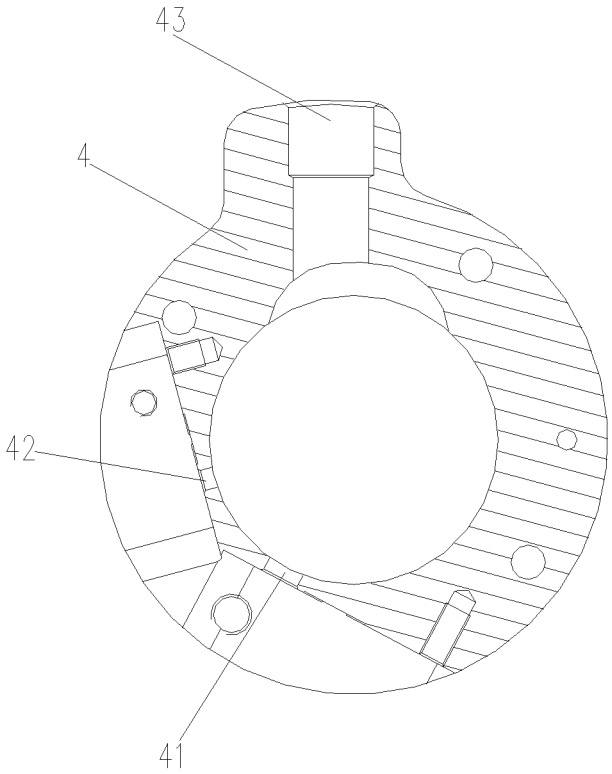
FIG. 2 is a schematic view of an internal structure of the cylinder in FIG. 1.

The drawings include the following reference signs:

1. piston; 11. pressure relief recess; 2. shaft; 3. piston sheath; 4. cylinder; 41, exhaust channel; 42, pressure relief channel; 43, suction channel; 5. compression chamber.

DETAILED DESCRIPTION

The embodiments in the present disclosure and the features in the embodiments can be combined with each other if there is no conflict. Hereinafter, the present disclosure will be described in detail with reference to the drawings and in conjunction with the embodiments.

Unless otherwise specified, all technical and scientific terms used in the present disclosure have the same meaning as commonly understood by those of ordinary skill in the technical field to which the present disclosure belongs.

In the present disclosure, if there is no explanation to the contrary, the orientation terms used, such as "up", "down", "top", "bottom" are usually used to describe directions shown in the drawings, or in terms of vertical, perpendicular, or gravitational direction of the component itself. Similarly, for ease of understanding and description, "inner" and "outer" refers to the inner and outer relative to the contour of the component itself. The above-described directional terms does not constitute limitation to the present disclosure.

An exhaust area is defined as a multiplication product of a radial distance, between a compression surface of a piston and a cylinder, and a cross-sectional height of the piston. It is found through research that during the exhaust process, the high-pressure gas outside the exhaust port has to firstly flow through the space between the compression surface of the piston and the cylinder before reaching the exhaust port. However, as the radial distance between the compression surface of the piston and the cylinder decreases, the exhaust area will become much smaller than the area of the exhaust port. As the distance decreases, the effective exhaust area also decreases, resulting in a large exhaust resistance and an increased exhaust pressure, which is larger than the designed exhaust pressure, so that over compression phenomenon occurs in the entire compression chamber, which affects the energy efficiency of the compressor.

In another solution known to the inventors, the cylinder is provided with a pressure relief channel to alleviate the over compression problem to a certain extent. However, it has been found through research that because the gas on the entire compression surface of the piston is all high-pressure gas, the pressure relief channel can only alleviate the over compression problem at the position near the pressure relief channel, and there is still the over compression phenomenon at the position far away from the pressure relief channel and the exhaust channel.

In view of this, the embodiments of the present disclosure provide a pump body assembly, a heat exchange apparatus, a fluid machine, and an operating method thereof, which can alleviate the over compression phenomenon of the pump body assembly during exhaust. Specifically, the fluid machine includes the pump body assembly described below. The heat exchange apparatus includes the fluid machine described below. In some embodiments, the fluid machine is a compressor.

Embodiment 1

Referring to FIGS. 1 to 9, a pump body assembly includes a piston 1, a shaft 2, a piston sheath 3, and a cylinder 4. The shaft 2 drives the piston 1 to rotate and reciprocate in the piston sheath 3 while rotating. The piston sheath 3 is located in the cylinder 4. A compression chamber 5 is defined between an outer circumferential wall of the piston 1 and an inner wall of the cylinder 4. A pressure relief recess 11 is defined in the outer circumferential wall of the piston 1 or the inner wall of the cylinder 4, and located at a position corresponding to the compression chamber 5.

It should be noted that, in the present embodiment, the pressure relief recess 11 extends in the outer circumferential wall of the piston 1.

By applying the technical solution of the present disclosure, the piston sheath 3 is located in the cylinder, and the compression chamber 5 is defined between the outer circumferential wall of the piston 1 and the inner wall of the cylinder 4. The pressure relief recess 11 is defined in the outer circumferential wall of the piston 1 or the inner wall of the cylinder 4, at the position corresponding to the compression chamber 5. When the pump body assembly is in the exhaust process, the gas away from the exhaust port can flow toward the exhaust port through the pressure relief recess 11, which increases the exhaust area and further alleviates the over compression in the pump body assembly during exhaust.

Referring to FIG. 1, other portions of the outer circumferential wall of the piston 1, except the position where the pressure relief recess 11 is located, can mate with the inner wall of the cylinder 4 during movement. The pressure relief recess 11 is provided in order to further alleviate the over compression of the gas in the compression chamber 5. The gas in the compression chamber 5 still needs to have a certain compression degree. Therefore, the outer circumferential wall of the piston 1, except the position where the pressure relief recess 11 is located, needs to mate with the inner wall of cylinder 4.

Figure 3:
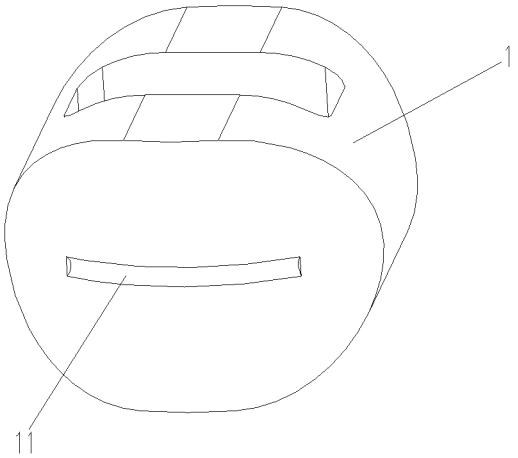
FIG. 3 is a schematic perspective view of the piston in FIG. 1.
Figure 4:
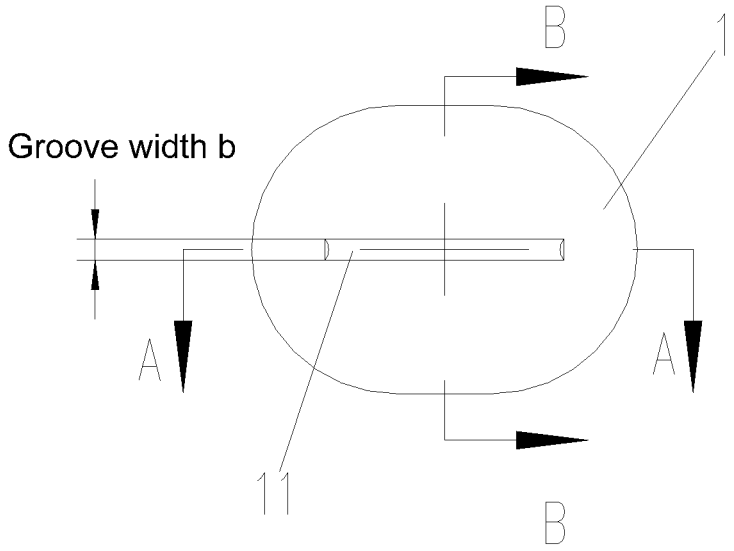
FIG. 4 is a front view of the piston in FIG. 3.

Referring to FIG. 3 and FIG. 4, the pressure relief recess 11 extends along the circumferential direction of the piston 1. It should be noted that the above-described extension of the pressure relief recess 11 along the circumferential direction of the piston 1 does not mean that the pressure relief recess 11 can only be a strip-shaped groove, but that the extension tendency of the pressure relief recess 11 is generally along the circumferential direction of the piston 1. In other words, the pressure relief recess 11 is distributed along the circumferential direction of the piston 1. The effect of the pressure relief recess 11 is to relieve the over compression of gas in the compression chamber 5. The pressure relief recess 11 is distributed along the circumferential direction of the piston 1, so that the relief recess 11 can encompass a large range of the compression chamber 5, and in the compression chamber 5, the gas that is not at the exhaust port can flow toward the exhaust port through the pressure relief recess 11, so as to better relieve the over compression phenomenon.

Figure 5:
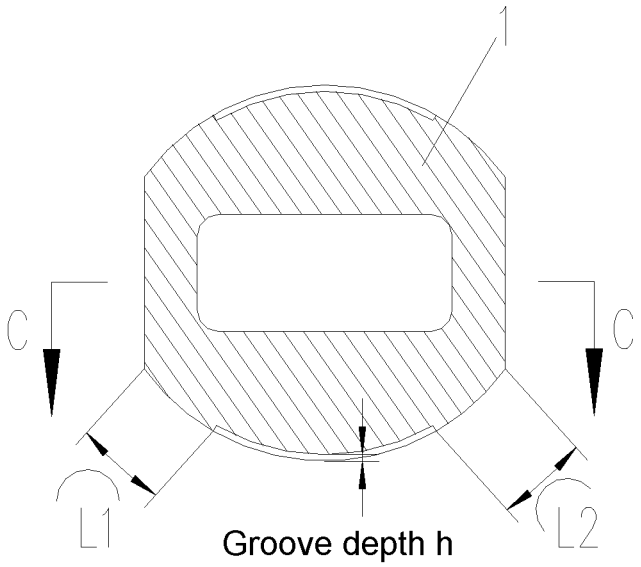
FIG. 5 is a cross-sectional view of the piston taken along A-A in FIG. 4.

Referring to FIG. 1, FIG. 3, FIG. 4, and FIG. 5, the sum of the arc lengths respectively between the two ends of the pressure relief recess 11 along the rotation direction of the piston 1 and the corresponding two ends of the compression chamber 5 is greater than or equal to 2 mm. Taking into account the independence of the two chambers of the pump body assembly and the need to avoid air leakage, at the end of the exhaust process, the pressure relief recess 11 cannot communicate with the exhaust port and the suction channel 43. Therefore, there is a need to provide sealing distances at the two ends of the pressure relief recess 11 defined in the piston 1. As shown in FIG. 1, when the exhaust of the pump body assembly is completed, the positions of the two ends of the piston 1 substantially coincide with the positions of the corresponding ends of the compression chamber 5. In the present embodiment, the two ends of the piston 1 are used as a reference, as shown in FIG. 5, the sealing distances are L1 and L2, and the sum of L1 and L2 is greater than or equal to 2 mm.

Referring to FIG. 1 and FIG. 5, the cylinder 4 also has an exhaust channel 41. The arc length between the end adjacent to the exhaust channel 41, in the two ends of the pressure relief recess 11 along the rotation direction of the piston 1, and the exhaust channel 41 is greater than or equal to 1 mm. In the present embodiment, this length corresponds to L1 shown in the drawings, i.e., L1 is greater than or equal to 1 mm. The gas at the exhaust port has a relatively high pressure, so the length of L1 is to be controlled. If the sealing distance is too small, high-pressure gas may enter the suction channel 43 through the pressure relief recess 11, affecting the suction of the pump body assembly. The gas at the suction port has a relatively low pressure, so the sealing distance L2 only needs to have a positive value.

In some embodiments of the present disclosure, the pressure relief recess 11 includes at least one pressure relief groove. On the condition that the pressure relief grooves are multiple, the multiple pressure relief grooves are communicated with or separated from each other. The pressure relief recess 11 is provided in order to alleviate the over compression in the pump body assembly. Every pump body assembly has its own over compression condition according to the compression amount and power of the pump body assembly. In practical use, the pressure relief recesses 11 in different forms can be adopted according to different conditions.

In the specific embodiments shown in FIG. 3 to FIG. 5, one pressure relief groove is adopted and the groove extends along the circumferential direction of the piston 1.

Figure 6:
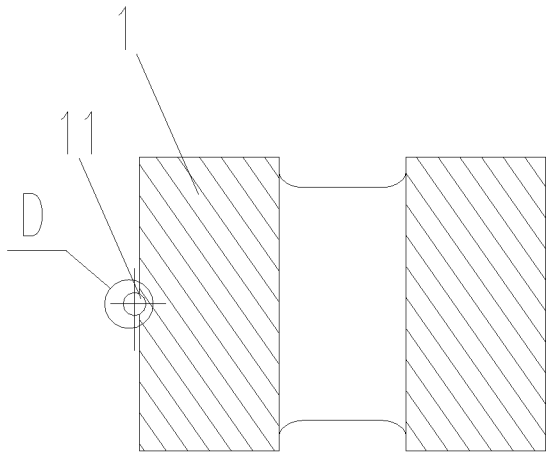
FIG. 6 is a cross-sectional view taken along B-B in FIG. 4, wherein the cross-section of the pressure relief recess is semicircular.
Figure 7:
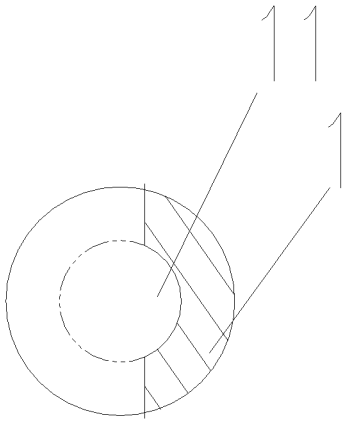
FIG. 7 is an enlarged view of portion D in FIG. 6.
Figure 8:
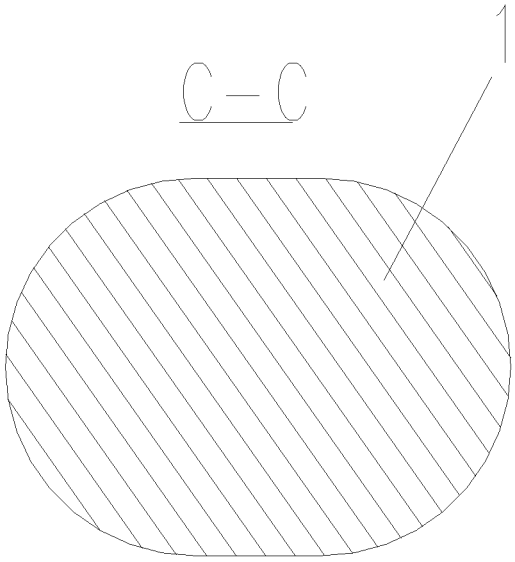
FIG. 8 is a cross-sectional view taken along C-C in FIG. 5.

Referring to FIG. 6 to FIG. 8, the groove width of each pressure relief groove is greater than or equal to 0.5 mm. Optionally, the groove depth of each pressure relief groove is greater than or equal to 0.1 mm. Optionally, the cross-sectional area of each pressure relief groove is greater than or equal to 0.025 $mm^2$. Every pressure relief groove is ultimately adopted to exhaust the high-pressure gas at the end of compression, and thus the pressure relief groove itself is also an exhaust channel. Meanwhile, the processing technology needs to be taken into account. The width, depth, and cross-sectional area of the pressure relief groove need to be controlled. In some embodiments, the groove width is 0.8 mm, the groove depth is 0.2 mm, and the cross-sectional area of the groove is 0.16 $mm^2$.

Figure 10:
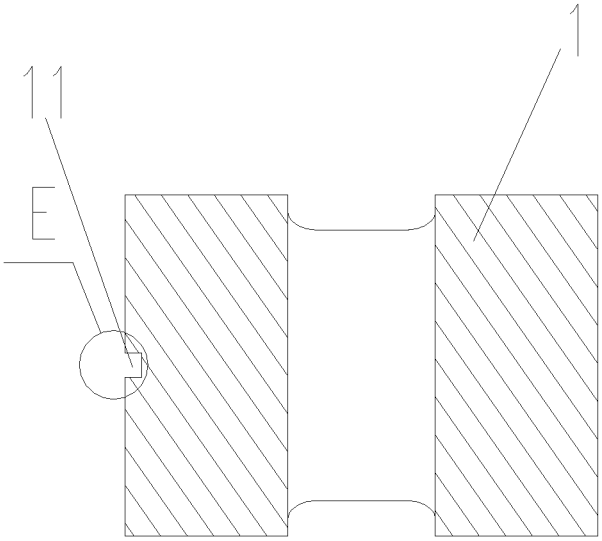
FIG. 10 is a cross-sectional view of the piston in a third embodiment of the pump body assembly of the present disclosure (its angle of view is similar to FIG. 6), wherein the cross-section of the pressure relief recess is rectangular.

Referring to FIG. 6 to FIG. 8, the ratio of the sum of the cross-sectional area of all pressure relief grooves to the cross-sectional area of the piston 1 along the direction perpendicular to the axis of the cylinder 4 is greater than or equal to 0.001 and smaller than or equal to 0.5. Referring to FIG. 10, the cross-sectional area of the piston 1 is determined according to the amount of compression of the pump body assembly. The pressure relief groove is provided in order to increase the effective exhaust area at the end of exhaust of the pump body assembly. Therefore, the controlling of the ratio of the two factors not only ensures that the pressure relief groove plays a role in alleviating the over compression, but also does not affect the amount of compression of the pump body assembly as much as possible.

Optionally, the cross-section of each pressure relief groove is rectangular or fan-shaped. The rectangular or fan-shaped cross-section of the pressure relief groove can be directly processed by a milling machine. In the present embodiment, the cross-section of the pressure relief groove is semicircular.

In the axial direction of the shaft 2, the distance between the pressure relief recess 11 and the edge of the piston 1 is greater than or equal to 1 mm. Considering the movement of the piston 1 in the cylinder, the upper and lower ends of the cylinder are deformed toward the piston cavity of the cylinder 4 under an action of gas force. In order to avoid "scratching" between the cylinder 4 and the edge of the piston 1 after the deformation of the cylinder 4, the distance between the pressure relief recess 11 and the edge of the piston 1 is greater than or equal to 1 mm.

Figure 9:
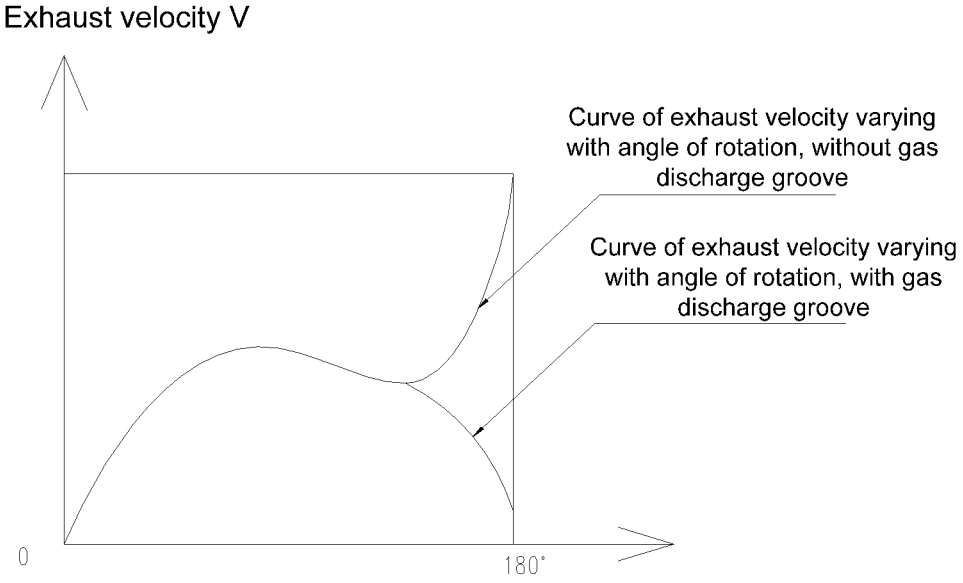
FIG. 9 shows a diagram comparing variations in exhaust velocity of the pump body assembly with angle of rotation in the first embodiment.

Referring to FIG. 9, the shaft 2 in the pump body assembly drives the piston 1 to rotate, the piston 1 only reciprocates relative to the piston sheath 3, and the two reciprocating motions are perpendicular to each other, during which the suction, compression and exhaust are realized. The pump body assembly has a single cylinder with double compression chambers. The two compression chambers 5 are independent from each other. For one chamber, the suction is started at the angle of 0° and completed at the angel from 0° to 180°, and the compression and exhaust are completed at the angle from 180° to 360°. The other compression chamber 5 is shifted by 180°, which means that when one compression chamber 5 completes suction and is about to enter the compression phase, the other compression chamber 5 completes exhaust and is about to enter the suction phase.

At the beginning of the exhaust, the exhaust area of the compression chamber 5 is the sum of the areas of the exhaust port and the pressure relief port:

$$S=(\pi d1\hat{}2)/4+(\pi d2\hat{}2)/4,$$

wherein d1 is the diameter of the exhaust port; d2 is the diameter of the pressure relief port.

At the end of the exhaust, the radial distance between the head of the piston 1 and the inner wall of the cylinder 4 continuously decreases. At this time, the exhaust area of the compression chamber 5 and the radial distance between the head of the piston 1 and the cylinder 4, as well as the sum of the perimeter of the exhaust port and the perimeter of the pressure relief port, satisfy the linear relationship:

$$S=(\pi d1+\pi d2)\times\Delta,$$

wherein Δ is the radial distance between the head of the piston 1 and the inner wall of the cylinder 4.

The compression chamber 5 gradually separates from the exhaust port, and during this process, the overlapping area between the compression chamber 5 and the exhaust port gradually decreases. At this time, the effective exhaust area S satisfies:

$$S=\delta\times(\pi d1+\pi d2)\times\Delta$$

wherein δ is the percentage of the effective contact.

The calculation formula of the theoretical exhaust velocity v of the rotary compressor is defined as follows:

$$v=V'/S$$

wherein V' is the volume variation rate of the compression chamber 5.

The angle at the beginning of the compression is defined as 0°, and the formula for calculating V' is as follows:

$$V'=(V\times\omega\times\sin\theta)/4$$

wherein V is the compressor cylinder displacement; ω is the angular velocity of the rotating shaft.

During the entire exhaust phase, the effective exhaust area of the compression chamber 5 and the variation in the theoretical exhaust velocity with the angle of rotation are shown in FIG. 9. It can be clearly seen that at the end of the compression, the effective exhaust area of the compression chamber 5 gradually decreases, and the theoretical exhaust velocity keeps increasing. At this time, the corresponding exhaust resistance keeps increasing, and a significant over compression phenomenon appears at the end of the exhaust, which seriously affects the compressor energy efficiency. As shown in FIG. 9, specifically, the curve of the exhaust velocity varying with the angle of rotation, with the pressure relief groove, is also shown in FIG. 9.

As shown in FIG. 1, the ratio of the volume of the pressure relief recess 11 to the cylinder displacement of the pump body assembly is greater than or equal to 0.001 and smaller than or equal to 0.02. The pressure relief recess is located at the head of the piston, which will increase the actual suction volume of the pump body during the suction process. During the exhaust process, the high-pressure gas in the pressure relief recess 11 will enter the next suction cycle. Thus, an over large pressure relief recess 11 will affect the suction process. Therefore, the ratio of the total volume of the pressure relief recess 11 in the piston to the cylinder displacement of the pump body assembly is greater than or equal to 0.001 and smaller than or equal to 0.02.

In the operating method of the fluid machine of the present disclosure, the fluid machine is the above-described fluid machine, and the cylinder of the fluid machine includes a suction channel, a pressure relief channel 42, and an exhaust channel 41 spaced from each other. The pressure relief channel 42 is communicated with the chamber of the cylinder through the pressure relief port. The exhaust channel 41 is communicated with the chamber of the cylinder through the exhaust port. The operating method includes: at the end of the exhaust of the fluid machine, the pressure relief recess 11 of the pump body assembly of the fluid machine is directly or indirectly communicated with the pressure relief port, while isolated from the exhaust port. At the end of the exhaust, the compression chamber 5 leaves the position of the exhaust port, and the gas in the compression chamber 5 can only be released through the pressure relief port. In order to achieve the pressure relief effect while avoiding gas leakage, at the end of the exhaust, the pressure relief recess 11 of the pump body assembly of the fluid machine is directly or indirectly communicated with the pressure relief port while isolated from the exhaust port.

Embodiment 2

The main difference between the present embodiment and embodiment 1 is that the pressure relief recess 11 is provided at the cylinder 4.

Specifically, the pump body assembly includes a piston 1, a shaft 2, a piston sheath 3, and a cylinder 4. The shaft 2 drives the piston 1 to rotate and reciprocate in the piston sheath 3 while rotating. The piston sheath 3 is located in the cylinder 4. A compression chamber 5 is formed between an outer circumferential wall of the piston 1 and the inner wall of the cylinder 4. A pressure relief recess 11 is defined in the inner wall of the cylinder 4 at a position corresponding to the compression chamber 5.

By applying the technical solution of the present disclosure, the piston sheath 3 is located in the cylinder, and the compression chamber 5 is defined between the outer circumferential wall of the piston 1 and the inner wall of the cylinder. The pressure relief recess 11 is defined in the outer circumferential wall of the piston 1 or the inner wall of the cylinder 4 at the position corresponding to the compression chamber 5. When the pump body assembly is in the exhaust process, the gas away from the exhaust port can be discharged from the exhaust port through the pressure relief recess 11, which increases the exhaust area and further alleviates the over compression in the pump body assembly during exhaust.

Optionally, in the axial direction of the shaft 2, the distance between the pressure relief recess 11 and the edge of the cylinder 4 is greater than or equal to 1 mm.

Embodiment 3

Figure 11:
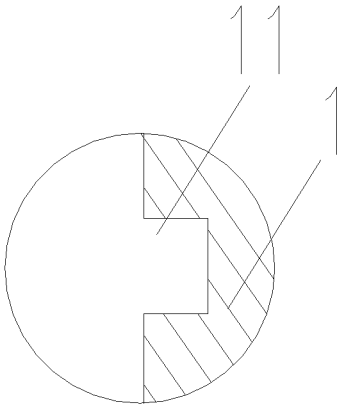
FIG. 11 is an enlarged view of portion E in FIG. 10.

The main difference between the present embodiment and embodiment 1 is that, as shown in FIG. 10 and FIG. 11, the cross-section of the pressure relief groove is rectangular, which is more convenient to process than semicircular. The cutter head only needs to be moved in one direction during the processing.

The present disclosure also provides various embodiments with different numbers of pressure relief grooves. Embodiments 4 to 6 are the embodiments with one pressure relief groove. Embodiments 7 to 10 are the embodiments with multiple pressure relief grooves. The pressure relief groove is provided in order to alleviate the over compression in the pump body assembly. Every pump body assembly has its own over compression condition according to the compression amount and power of the pump body assembly. In practical use, the pressure relief recesses 11 in different forms can be adopted according to different conditions. Considering the convenience of processing, in embodiment 1, only one pressure relief groove extending along the circumferential direction of the piston 1 is provided.

Embodiment 4

Same as embodiment 1, the number of the pressure relief groove is one. The difference is that the extension direction of the pressure relief groove is different from that in embodiment 1.

Figure 12:
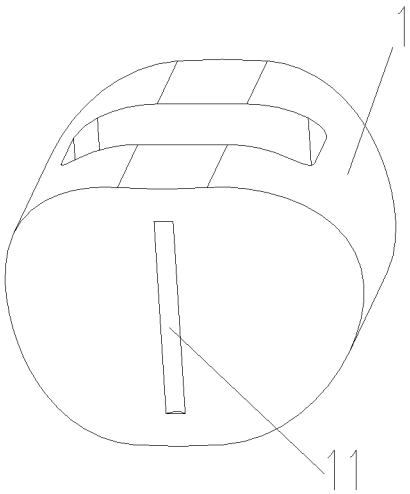
FIG. 12 is a schematic structural view of the piston in a fourth embodiment of the pump body assembly of the present disclosure.

In the specific embodiment shown in FIG. 12, the number of the pressure relief groove is one, and the pressure relief groove extends along the axial direction of the shaft.

Embodiment 5

Same as embodiment 1, the number of the pressure relief groove is one. The difference is that the extension direction of the pressure relief groove is different from that in embodiment 1.

Figure 13:
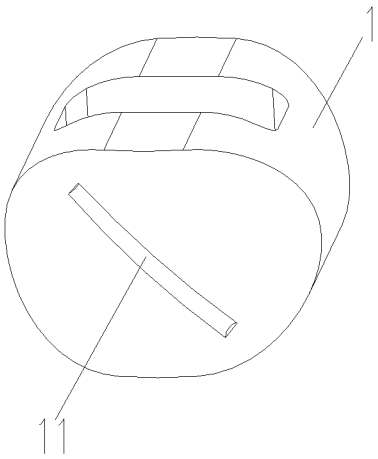
FIG. 13 is a schematic structural view of the piston in a fifth embodiment of the pump body assembly of the present disclosure.

In the specific embodiment shown in FIG. 13, the number of the pressure relief groove is one, an included angle exists between the pressure relief groove and the axial direction of the shaft, and the included angle is not equal to 90 degrees.

Embodiment 6

Same as embodiment 1, the number of the pressure relief groove is one. The difference is that the shape of the pressure relief groove is different from that in embodiment 1.

Figure 14:
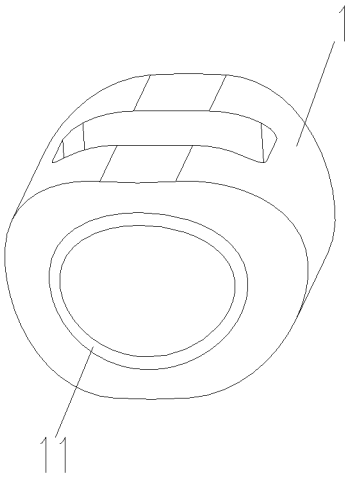
FIG. 14 is a schematic structural view of the piston in a sixth embodiment of the pump body assembly of the present disclosure.

In the specific embodiment shown in FIG. 14, the number of the pressure relief groove is one, and the pressure relief groove has a ring shape.

Embodiment 7

The difference from embodiment 1 is that the number of the pressure relief grooves is different from that in embodiment 1.

Figure 15:
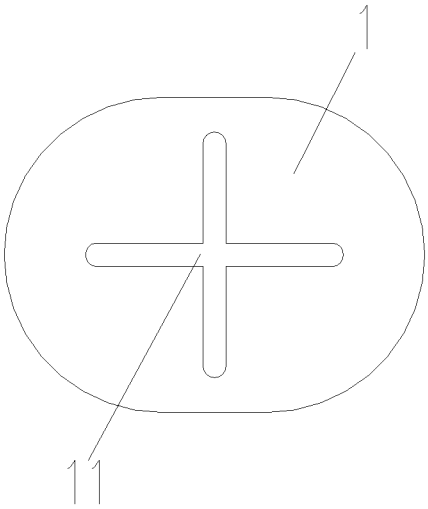
FIG. 15 is a schematic structural view of the piston in a seventh embodiment of the pump body assembly of the present disclosure.

In the specific embodiment shown in FIG. 15, the number of the pressure relief grooves is two, and the two pressure relief grooves are crossed.

Embodiment 8

Same as embodiment 7, the number of the pressure relief grooves is plural. The difference from embodiment 7 is that the shape of the pressure relief grooves is different.

Figure 16:
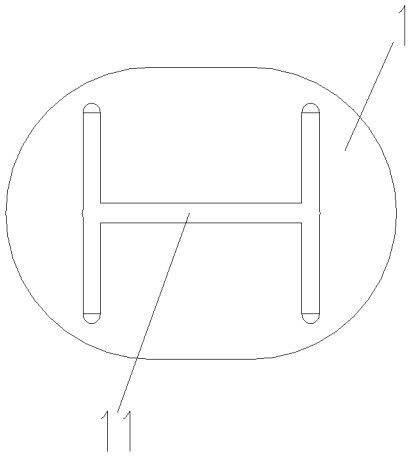
FIG. 16 is a schematic structural view of the piston in an eighth embodiment of the pump body assembly of the present disclosure.

In the specific embodiment shown in FIG. 16, the number of the pressure relief grooves is three, and the three pressure relief grooves are in a shape of H.

Of course, the combination of the three pressure relief grooves can also be in a shape of I.

Embodiment 9

Same as embodiment 7, the number of the pressure relief grooves is plural. The difference from embodiment 7 is that the shape of the pressure relief grooves is different.

Figure 17:
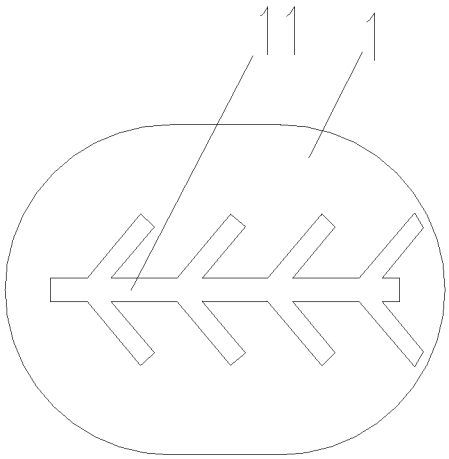
FIG. 17 is a schematic structural view of the piston in a ninth embodiment of the pump body assembly of the present disclosure.

In the specific embodiment shown in FIG. 17, the pressure relief grooves are multiple and have a fishbone shape.

Embodiment 10

Same as embodiment 7, the number of the pressure relief grooves is plural. The difference from embodiment 7 is that the shape of the pressure relief groove is different.

Figure 18:
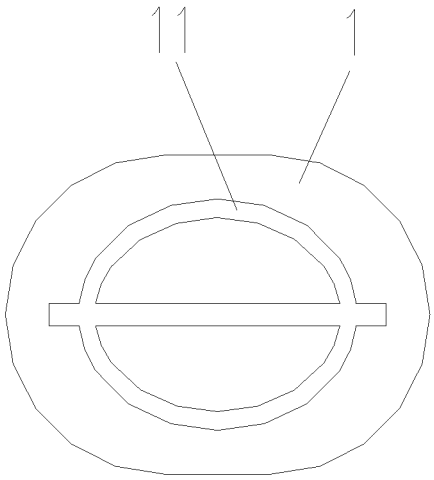
FIG. 18 is a schematic structural view of the piston in a tenth embodiment of the pump body assembly of the present disclosure.

In the specific embodiment shown in FIG. 18, the number of the pressure relief grooves is two: the first pressure relief groove extends along the circumferential direction of the piston 1 or the circumferential direction of the cylinder 4, and the second pressure relief groove has a ring shape and is crossed with the first pressure relief groove.

In the above-described embodiments of the present disclosure, the piston sheath is located in the cylinder, the compression chamber is formed between the outer circumferential wall of the piston and the inner wall of the cylinder, and the pressure relief recess is provided in the outer circumferential wall of the piston or the inner wall of the cylinder at the position corresponding to the compression chamber. When the pump body assembly is in the exhaust process, the gas away from the exhaust port can flow toward the exhaust port through the pressure relief recess, which increases the exhaust area and further alleviates the over compression in the pump body assembly during the exhaust.

Obviously, the embodiments described above are only a part of the embodiments of the present disclosure, rather than all of the embodiments. Based on the embodiments in the present disclosure, all other embodiments obtained by those of ordinary skill in the art without creative work should fall within the protection scope of the present disclosure.

It should be noted that the terms used herein are only for describing specific embodiments, and are not intended to limit the exemplary embodiments according to the present disclosure. As used herein, unless the context clearly indicates otherwise, the singular form is also intended to include the plural form. In addition, it should also be understood that when the terms "comprise" and/or "include" are used in the specification, they indicate that there are features, steps, works, devices, components, and/or combinations thereof.

The terms "first", "second", etc. in the specification and claims of the present disclosure and the drawings are used to distinguish similar objects, and are not necessarily used to describe a specific sequence or order. It should be understood that the data used in this way can be interchanged under appropriate circumstances so that the embodiments of the present disclosure described herein can be implemented in a sequence other than those illustrated or described herein.

The above descriptions are only preferred embodiments of the present disclosure and are not intended to limit the present disclosure. For those skilled in the art, the present disclosure may have various modifications and changes. Any modification, equivalent replacement, improvement, etc. made within the spirit and principle of the present disclosure shall be included in the protection scope of the present disclosure.

What is claimed is:

1. A pump body assembly, comprising:

a piston;

a shaft;

a piston sheath, the shaft driving the piston to rotate and reciprocate in the piston sheath while rotating; and a cylinder comprising an exhaust channel, the piston sheath being located in the cylinder, wherein a compression chamber is defined between an outer circumferential wall of the piston and an inner wall of the cylinder, and a pressure relief recess is defined in the outer circumferential wall of the piston, such that, on a condition that the pump body assembly is in an exhaust process, gas which is in the compression chamber and away from the exhaust channel is capable of being discharged from the exhaust channel through the pressure relief recess;

wherein other portions of the outer circumferential wall of the piston, except the position where the pressure relief recess is located, are capable of mating with the inner wall of the cylinder during movement.

2. The pump body assembly according to claim 1, wherein the pressure relief recess extends along a circumferential direction of the piston.

3. The pump body assembly according to claim 2, wherein a sum of arc lengths respectively between two ends of the pressure relief recess along a rotation direction of the piston and corresponding two ends of the compression chamber is greater than or equal to 2 mm.

4. The pump body assembly according to claim 2, wherein the cylinder further comprises an exhaust channel, and in two ends of the pressure relief recess along a rotation direction of the piston, an arc length between an end adjacent to the exhaust channel and the exhaust channel is greater than or equal to 1 mm.

5. The pump body assembly according to claim 1, wherein in an axial direction of the shaft, a distance between the pressure relief recess and an edge of the piston is greater than or equal to 1 mm; or in an axial direction of the shaft, a distance between the pressure relief recess and an edge of the cylinder is greater than or equal to 1 mm.

6. The pump body assembly according to claim 1, wherein the pressure relief recess comprises at least one pressure relief groove; on a condition that the pressure relief grooves are multiple, the multiple pressure relief grooves are communicated with or separated from each other.

7. The pump body assembly according to claim 6, wherein a groove width of each pressure relief groove is greater than or equal to 0.5 mm.

8. The pump body assembly according to claim 6, wherein a groove depth of each pressure relief groove is greater than or equal to 0.1 mm.

9. The pump body assembly according to claim 6, wherein a cross-sectional area of all pressure relief grooves is greater than or equal to 0.025 $mm^2$.

10. The pump body assembly according to claim 6, wherein a ratio of a sum of a cross-sectional area of all pressure relief grooves to a cross-sectional area of the piston along a direction perpendicular to an axis of the cylinder is greater than or equal to 0.001 and smaller than or equal to 0.5.

11. The pump body assembly according to claim 6, wherein the cross-section of each pressure relief groove is rectangular or fan-shaped.

12. The pump body assembly according to claim 6, wherein the number of the pressure relief groove is one, and the pressure relief groove extends along a circumferential direction of the piston; or the number of the pressure relief grooves is two, and the two pressure relief grooves are crossed; or the number of the pressure relief grooves is three, and the three pressure relief grooves are in a shape of H; or the number of the pressure relief grooves is three, and the three pressure relief grooves are in a shape of I; or the number of the pressure relief grooves is plural, and the pressure relief grooves are in a fishbone shape; or the number of the pressure relief grooves is two, wherein a first pressure relief groove extends along a circumferential direction of the piston, and a second pressure relief groove has a ring shape and is crossed with the first pressure relief groove.

13. The pump body assembly according to claim 1, wherein a ratio of a volume of the pressure relief recess to a cylinder displacement of the pump body assembly is greater than or equal to 0.001 and smaller than or equal to 0.02.

14. A fluid machine comprising the pump body assembly according to claim 1.

15. The fluid machine according to claim 14, wherein the fluid machine is a compressor.

16. A heat exchange apparatus, comprising the fluid machine according to claim 14.

17. An operating method of the fluid machine according to claim 14, wherein the cylinder of the fluid machine defines a suction channel, a pressure relief channel, and an exhaust channel spaced from each other; the pressure relief channel is communicated with the chamber of the cylinder through a pressure relief port, and the exhaust channel is communicated with the chamber of the cylinder through an exhaust port; the operating method comprises:

at the end of exhaust of the fluid machine, the pressure relief recess of the pump body assembly of the fluid machine is directly or indirectly communicated with the pressure relief port while isolated from the exhaust port.

18. A pump body assembly, comprising:

a piston;

a shaft;

a piston sheath, the shaft driving the piston to rotate and reciprocate in the piston sheath while rotating; and a cylinder comprising an exhaust channel, the piston sheath being located in the cylinder, wherein a compression chamber is defined between an outer circumferential wall of the piston and an inner wall of the cylinder, and a pressure relief recess is defined in the outer circumferential wall of the piston such that, on a condition that the pump body is in an exhaust process, gas which is in the compression chamber and away from the exhaust channel is capable of being discharged from the exhaust channel through the pressure relief recess;

wherein the pressure relief recess extends along a circumferential direction of the piston.

* * * * *